United States Patent [19]

Leitner

[11] 4,237,946

[45] Dec. 9, 1980

[54] CHUCK FOR HOLDING AND DRIVING FASTENERS, SUCH AS SCREWS OR NAILS

[76] Inventor: Kajetan J. Leitner, Am Winacker 18, 8170 Bad Tölz, Fed. Rep. of Germany

[21] Appl. No.: 32,321

[22] Filed: Apr. 23, 1979

Related U.S. Application Data

[63] Continuation of Ser. No. 797,394, May 16, 1977, abandoned.

[30] Foreign Application Priority Data

May 17, 1976 [DE] Fed. Rep. of Germany ..... 2621932

[51] Int. Cl.[3] ..... B25B 23/10

[52] U.S. Cl. ..... 81/429; 144/32 R; 279/75; 81/451

[58] Field of Search ..... 145/52, 50; 144/32; 279/75, 30, 22

[56] References Cited

U.S. PATENT DOCUMENTS

| | | | |
|---|---|---|---|
| 2,840,126 | 6/1958 | Schmitt | 145/52 |
| 3,967,664 | 7/1976 | Lesner et al. | 144/32 R |

FOREIGN PATENT DOCUMENTS

| | | | |
|---|---|---|---|
| 372622 | 11/1963 | Switzerland | 144/32 |

*Primary Examiner*—Nicholas P. Godici
*Assistant Examiner*—Roscoe V. Parker
*Attorney, Agent, or Firm*—O'Brien & Marks

[57] ABSTRACT

A chuck for holding and driving fasteners such as screws or nails comprises a spring-loaded bearing sleeve with fastener-clamping balls and a spring-loaded clamping sleeve tapered to constrict the balls around the shank of a fastener inserted into the chuck, the clamping sleeve having a space to receive the balls during insertion of the fastener and for releasing the fastener, after completion of the driving operation.

2 Claims, 10 Drawing Figures

Figure 1:
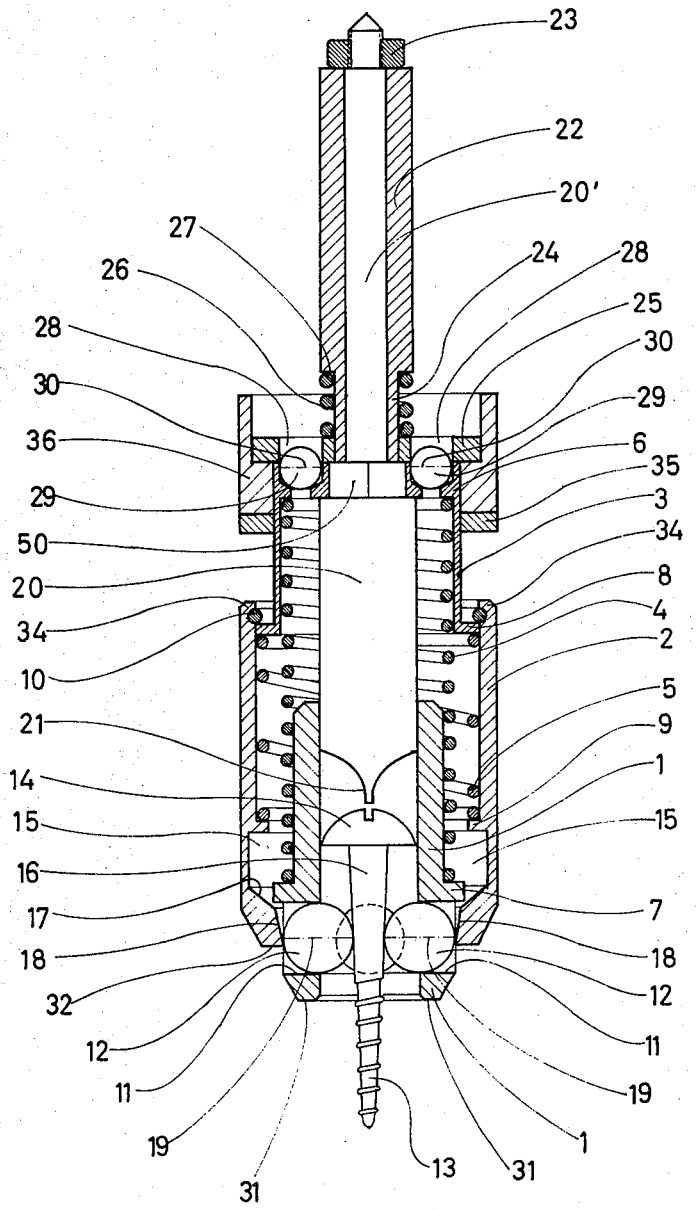

Fig. 2
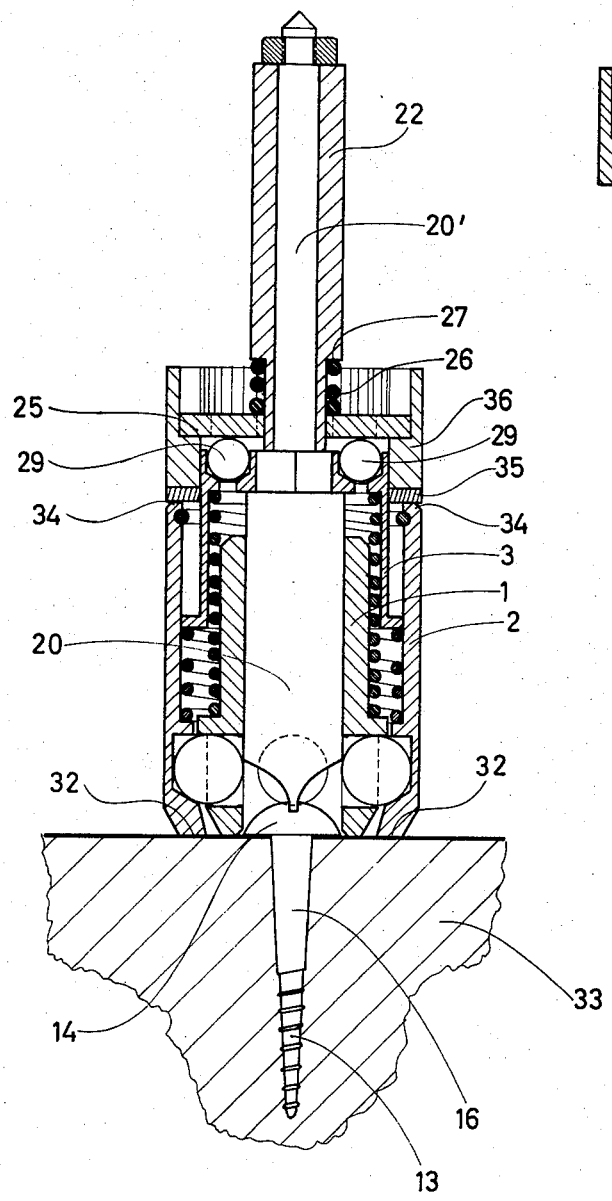
Fig. 3
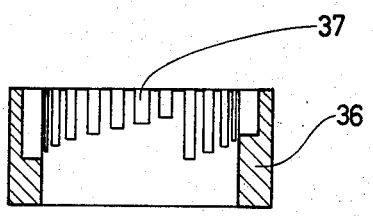
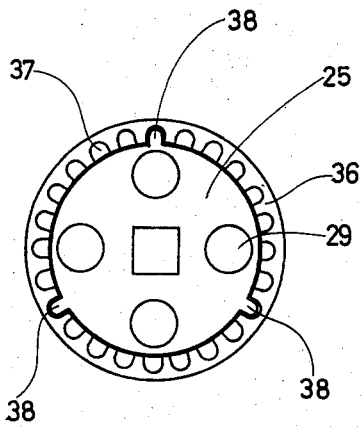
Fig. 4

CHUCK FOR HOLDING AND DRIVING FASTENERS, SUCH AS SCREWS OR NAILS

CROSS REFERENCE TO RELATED APPLICATION

This is a continuation application of pending application Ser. No. 797,394, filed May 16, 1977 and now abandoned.

This invention relates to a chuck for holding and driving into workpieces fasteners such as headed or stud screws or nails. As applied to a chuck for screws, the chuck comprises a bearing sleeve with clamping balls grasping the shank of the screw and mounted radially displaceably in the bearing sleeve, a clamping sleeve enclosing the bearing sleeve for the clamping balls and an axially displaceable screw-driving shaft penetrating the bearing sleeve and provided with a screw-driving member, the clamping sleeve and bearing sleeve being each longitudinally displaceably arranged against the force of a spring, the clamping sleeve being provided in the region of the holding position of the clamping balls with a clamping taper which, under the action of the spring stress, presses the clamping balls together and thus against the shank of the screw, and a free space being provided axially beside the clamping taper to receive the clamping balls on the introduction of a headed screw.

In known chucks of this kind either it is necessary to load the chuck from the rear, which requires a separate feed mechanism, or the rotary drive of the chuck must be halted and subsequently started again for the insertion of a screw.

The invention is based upon the problem of producing a chuck of the initially described kind which can be loaded from the front while running, that is with the drive rotating.

According to the invention this is effected in that both the bearing sleeve and the clamping sleeve are subject to the stress of a spring each in the same direction, which springs press these two sleeves forward from an abutment tube lying at the rear end of the chuck and protruding into the clamping sleeve, the clamping sleeve placing itself with its rear end behind an outwardly directed projection of the abutment tube and the bearing sleeve running with a shoulder seated axially behind the clamping balls against an inwardly extending stop on the forward end of the clamping sleeve, in that the clamping taper of the clamping sleeve lies at its forward end and is followed towards the abutment tube by the free space for the reception of the clamping balls on the introduction of a headed screw, and in that in the condition before the loading of the chuck the screw engaging member is withdrawn so far behind the free space that a screw inserted from the front through the clamping balls after the entry of the clamping balls into the clamping taper is held clamped with its end protruding into the chuck at a distance before the screw engaging member.

Due to this arrangement of the bearing sleeve and the clamping sleeve and of the springs acting upon these sleeves the possibility exists of pushing the bearing sleeve back against the clamping sleeve by pressure of a screw inserted from the front, in which case the balls yield into the free space and then possibly snap over a screw head, since under the action of the spring acting upon the bearing sleeve the latter pushes the balls forward again, namely into the clamping taper. The screw driving shaft does not participate in these displacement operations, so that it can be retracted so far behind the free space that its screw-engaging member does not yet reach the relevant screw end. Thus the screw-engaging member is initially situated at a distance before the relevant screw end, the screw however being held clamped by the chuck. If then for the screwing operation the screw driving system is pressed forward from behind, the screw places itself with its end protruding from the chuck against the relevant workpiece and is pressed by the latter into the chuck, the screw being held clamped by the chuck even if, as is usual in wood screws it is itself made somewhat tapered. In this case in fact under the action of the spring stress acting upon the bearing sleeve, the balls shift in the clamping taper whereby a variation of the diameter of the screw is compensated as it slides into the chuck. The screw then slides into the chuck until it is engaged by the screw-engaging member which thereupon drives it. The screw then screws itself into the workpiece until the latter runs against the front end face of the bearing sleeve protruding from the chuck and gradually pushes the latter back. In this way the workpiece finally also reaches the clamping sleeve which then likewise is pressed back in relation to the screw driving shaft, until finally the screw is screwed in fully. In the pushing back of the bearing sleeve the balls are entrained and can finally yield into the free space, the clamping of the screw being released. Its guidance is however maintained on the one hand by the workpiece and on the other by the screw engaging member, a secure position of the chuck in relation to the workpiece being maintained due to the fact that, as stated, the end faces of bearing sleeve and clamping sleeve rest against the workpiece in the final phase of screwing in.

A simple design solution for the formation of the shoulder of the bearing sleeve is obtained if this shoulder is formed as an outwardly directed collar against which the spring initially stressing the bearing sleeve presses. Correspondingly the locking sleeve can advantageously be provided behind the free space with an inwardly directed collar against which the spring initially stressing the locking sleeve presses.

So that at the end of the screw driving operation the screw driving shaft may be uncoupled from its drive, the chuck is expediently so designed that several coupling balls are partially embedded in the rear end face of the abutment tube protruding nearly halfway from this end face and against this end face there presses a perforated plate initially stressed by a compression spring and receiving the protruding ball parts in holes, which plate is coupled axially displaceably in force-engaging manner with a drive sleeve rotatably mounted on the screw driving shaft, the screw driving shaft being connected in force-engaging manner with the abutment tube and the compression spring being seated between the drive sleeve and the perforated plate.

The coupling is here effected through the coupling balls by the perforated plate and the abutment tube receiving the coupling balls, the perforated plate finally being lifted away from the rear end face of the abutment tube. In the driving in of the screw in fact in the last part of this operation the abutment tube receiving the coupling balls slides into the clamping sleeve so that a relative movement also occurs between the clamping sleeve and the perforated plate pressed against the abutment tube, until a position is reached in which the rear end face of the clamping sleeve can act upon the perforated plate.

In order to be able to make this lifting of the perforated plate away from the abutment tube dependent upon a specific depth of screwing in of the screw, the perforated plate is provided with at least two noses protruding radially outwards beyond the diameter of the abutment tube, which engage in grooves of graduated different axial lengths of a setting sleeve which surrounds the abutment tube and is axially displaceable and rotatable in relation thereto. By rotation of the setting sleeve then in each case grooves of corresponding length are placed opposite to the noses of the perforated plate, whereby the relative position of screw engaging member and thus perforated plate on the one hand and rear end face of the abutment tube with the coupling balls on the other can be adjusted.

Another type of coupling between drive and screw driving shaft is formed so that radially inwardly protruding coupling pins are let into the abutment tube in one plane and these coupling pins are pressed by means of a compression spring acting upon the abutment tube against a correspondingly grooved annular shoulder of the screw driving shaft, a drive sleeve supporting the compression spring being mounted rotatably without axial mobility on the screw driving shaft, which sleeve engages in force-engaging manner displaceably with the abutment tube. This type of coupling permits a stepless adjustment of the uncoupling, for which purpose a set screw is inserted axially parallel into the abutment tube beside the drive sleeve and reaches into the internal space behind the abutment tube and forms a stop for the bearing sleeve, which stop on application of the bearing sleeve effects a lifting of the coupling pins out of the grooves of the annular shoulder. With this type of coupling the rear end face of the bearing sleeve finallyu strikes against the set screw and thus presses the abutment tube to the rear in relation to the screw driving shaft, whereby the uncoupling operation is initiated.

Figure 5:
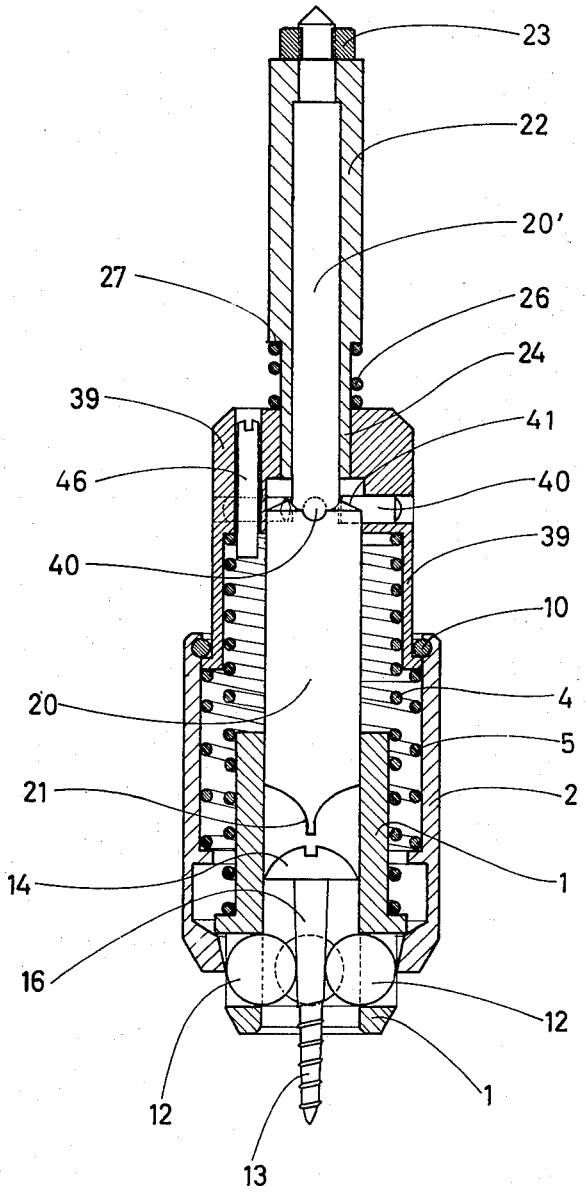
Figure 6:
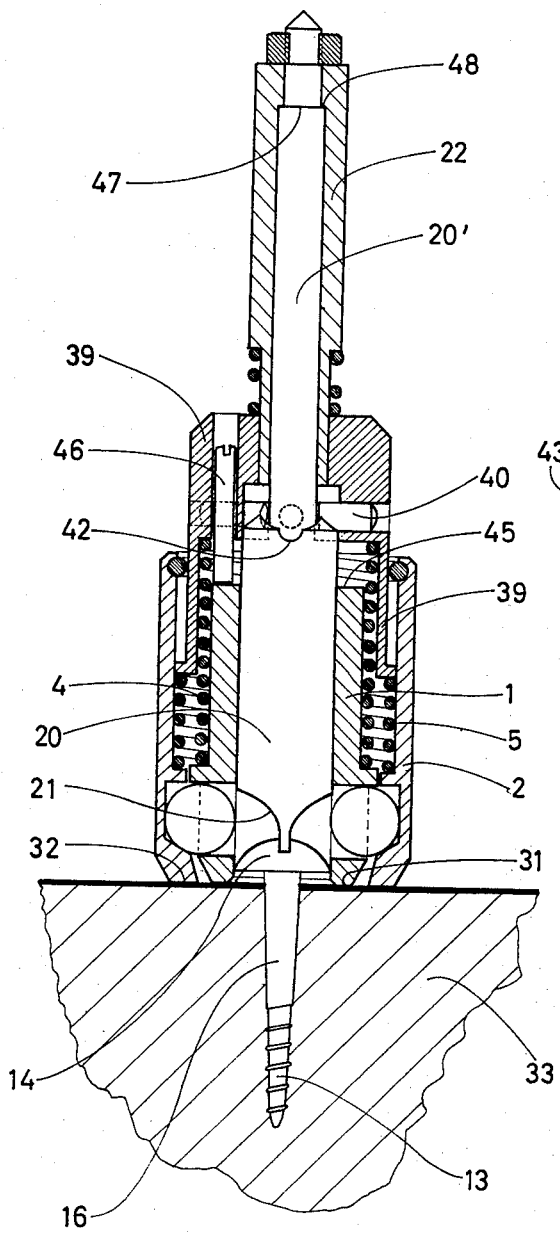
Figure 7:
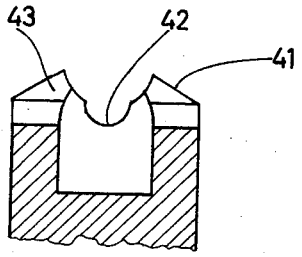
Figure 8:
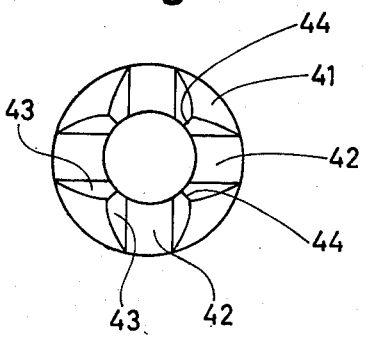
Figure 9:
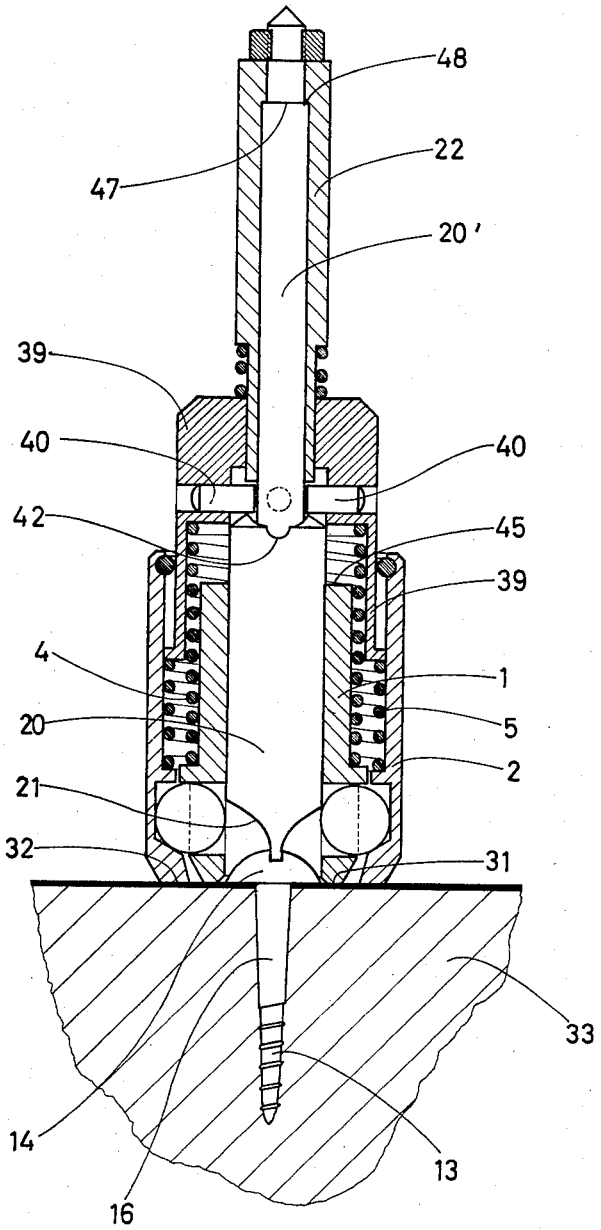
Figure 10:
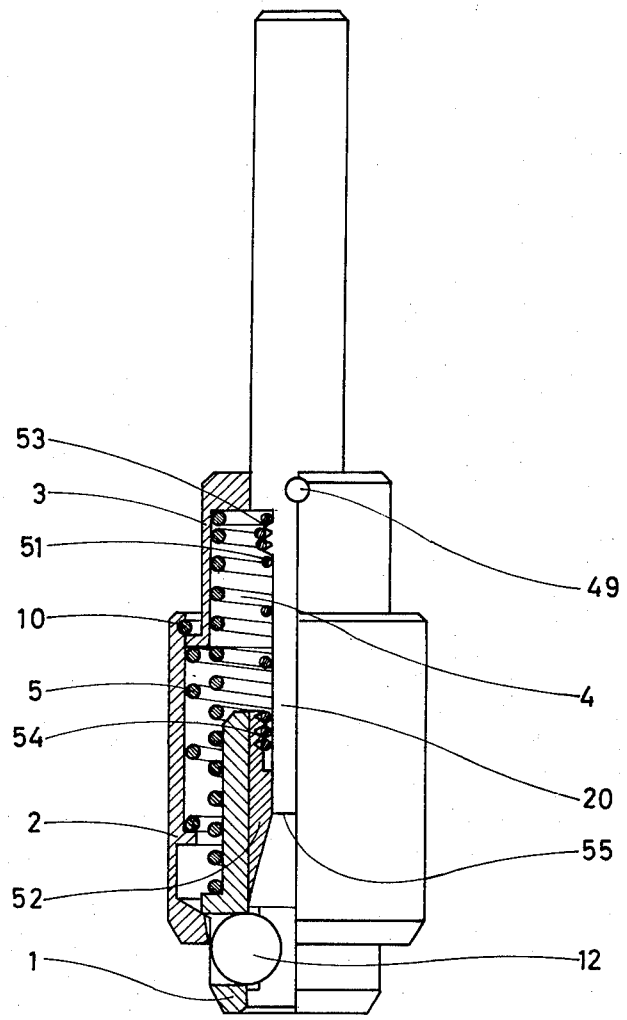

Examples of embodiment of the invention are represented on the accompanying drawings, in which:

FIG. 1 shows a form of embodiment with a coupling comprising coupling balls, where a screw is held clamped by the chuck at the beginning of the screwing-in operation, FIG. 2 shows the same form of embodiment in the position with the screw completely screwed in and the coupling uncoupled, FIG. 3 shows the setting sleeve as used in the form of embodiment according to FIGS. 1 and 2, in section, FIG. 4 shows a plan view of the setting sleeve with perforated plate lying therein, FIG. 5 shows a form of embodiment with a coupling using coupling pins, in a position clamping a screw before the screwing-in operation (see FIG. 1), FIG. 6 shows the form of embodiment according to FIG. 5 in a position in which the coupling is just lifting away, FIG. 7 shows the annular shoulder of the screw driving shaft according to the form of embodiment as shown in FIGS. 5 and 6, FIG. 8 shows a plan view of this annular shoulder of the screw driving shaft, FIG. 9 shows the form of embodiment according to FIGS. 5 and 6 in the completely uncoupled condition with the screw in the completely screwed-in position, FIG. 10 shows a form of embodiment for nail driving.

The chuck as illustrated in section in FIG. 1 consists of the bearing sleeve 1 and the clamping sleeve 2 surrounding it, into the rearward end of which the abutment tube 3 extends. Against this abutment tube 3 bear the springs 4 and 5, the spring 4 placing itself on the one hand against an inwardly extending collar 6 of the abutment tube 3 and on the other against an outwardly extending collar 7 of the bearing sleeve 1. The spring 4 here presses the bearing sleeve 1 away from the abutment tube 3. The spring 5 is seated between the outwardly extending collar 8 of the abutment tube 3 and the inwardly extending collar 9 of the clamping sleeve 2, so that the clamping sleeve 2 is also pressed away from the abutment tube 3 under the action of the spring 5. An abutment is provided here for the clamping sleeve 2 by the circular clip or snap ring 10 which is seated behind the collar 8 of the abutment tube 3 and held there by reason of the stress of the spring 5. The bearing sleeve 1 is provided with four apertures 11 in each of which a clamping ball 12 is mounted. When the chuck is in the position as illustrated the clamping balls are hindered from sliding outwards by the forward end face of the clamping sleeve 2. Inwards the apertures 11 possess a slight constriction (not shown in the Figure) before which the equators of the clamping balls 12 place themselves, so that the balls cannot fall inwards out of the apertures 11.

In FIG. 1 the chuck is represented with a clamped-in screw 13. In order to bring the screw 13 into the position as illustrated, firstly it is pressed from beneath with its screw head 14 against the clamping balls 12, which then yield with the bearing sleeve 1 inwards into the chuck against the stress of the spring 4 until the clamping balls 12 come into the region of the free spaces 15 in the clamping sleeve 2 and yield into these free spaces 15. Bearing sleeve 1, clamping sleeve 2 and clamping balls 12 then assume the position as illustrated in FIG. 2 (apart from the position of the screw turning member). If now the screw head 14 is pressed still further inwards, finally the clamping balls 12 can run inwards against the shank 16 of the screw 13, firstly sliding along the guide taper 17 at the forward end of the clamping sleeve 2 until they come into the clamping taper 18, under the action of which the clamping balls 12 are pressed together since at the same time the spring 4 presses the bearing sleeve 1 forward. The clamping balls 12 then travel along the relatively slender clamping taper 18 so that a considerable pressing force of the clamping balls 12 against the shank 16 of the screw 13 is achieved. The screw 13 and the clamping balls 12 have then reached the position as illustrated in FIG. 1. In this position the equator 19 of the clamping balls 12 is seated just behind the forward end of the clamping taper 18 so that the position as illustrated corresponds approximately to the minimum diameter of a clampable screw. In the case of a larger diameter of a screw the equator 19 lies further inwards in the clamping taper 18. If the chuck has received no screw, the forward outer edge of the collar 7 of the bearing sleeve 1 strikes against the inwardly directed stop or guide taper 17, whereby the forward end position is reached. In this position the equator 19 of the clamping balls 12 is seated approximately at the end of the clamping taper 18, so that as already stated the balls 12 are prevented from falling outwards.

The chuck as illustrated in FIG. 1 is further provided with the screw driving shaft 20 on the forward end of which there is arranged the screw-engaging member, here the screw driver blade 21. To the rear the screw driving shaft merges into a thinner part 20' on which the drive sleeve 22 is rotatably seated. To the rear the drive sleeve 22 is held by the nut 23 which is screwed on to the end of the thinner part 20' of the screw driving shaft 20. At its forward end the drive sleeve 22 possesses the square neck 24 over which the perforated plate 25 is pushed. Internally the perforated plate 25 possesses an aperture fitting the square neck 24, so that there is a force-engaging connection between the square neck 24 and thus the drive sleeve 22 on the one hand and the perforated plate 25 on the other. The perforated plate 25 is axially displaceably mounted on the square neck 24 and is pressed away from the drive sleeve 22 by the spring 26. Irrespective of the perforated plate 25 in relation to the shoulder 27 of the drive sleeve 22, the above-mentioned force-engaging connection always exists between drive sleeve 22 and perforated plate 25, so that on rotation of the drive sleeve 22 the perforated plate 25 is always driven with it.

For the screwing in of the screw 13 now the drive sleeve 22 is inserted into an appropriate mounting of the drive machine (not shown) and set in rotation. At the same time the drive machine and thus the drive sleeve 22 are pressed forward, the screw 13 clamped in by the chuck placing itself against the relevant workpiece (not shown). The screw 13 is then pressed inwards into the chuck by the workpiece, and the clamping balls 12, in the case of the screw 13 with tapered shank 16 as illustrated here, run together correspondingly under the action of the clamping taper 18 and in doing so keep the screw clamped. The screw 13 finally comes with its head 14 into engagement with the blade 21 and is driven by the latter and thus screwed into the workpiece.

The rotation of the screw driving shaft 20, during which the screw 13 can already be inserted, comes about as follows: As mentioned above the perforated plate 25 is connected in force-engaging manner with the drive sleeve 22 which is set in rotation. The perforated plate 25 is provided with four apertures 28 into which coupling balls 29 extend nearly halfway. The coupling balls 29 are fixedly inserted into the rear end face of the abutment tube 3 and therefore form a rigid connection with the abutment tube 3. The apertures 28 of the perforated plate 25 now have a slightly larger diameter than the coupling balls 29, so that they place themselves close beside the equator 30, entered in dot-and-dash lines, of the coupling balls 29. At this point the coupling balls project almost at right angles to the end face of the abutment tube 3, so that in effect the coupling balls 29 act as an engaging member in relation to the perforated plate 25. Thus a force-engaging connection is constituted between the perforated plate 25 and the coupling balls 29, which signifies that as a whole there is a force engagement from the drive sleeve 22 through the square neck 24, the perforated plate 25, the coupling balls 29 and the abutment tube 3. Now there is likewise a force-engaging connection between the abutment tube 3 and the screw driving shaft 20, namely through the hexagon 50 as conponent of the screw driving shaft 20, which engages in a corresponding internal hexagon of the abutment tube 3. In this way thus in the position as illustrated the rotation of the drive sleeve 22 is transmitted to the screw driving shaft 20.

In the driving in of the screw 13 finally the forward end face 31 of the bearing sleeve 1 places itself against the relevant workpiece and is pressed back by the latter into the chuck. Then in fact the clamping balls 12 disengage themselves from the shank 16 of the screw 13, which however is of no further importance in this working phase since the screw 13 is already adequately guided by the workpiece. On the other hand the chuck is held in place in relation to the workpiece due to the fact that as stated the forward end face 31 of the bearing sleeve 1 presses against the workpiece. In the further course of the screw driving operation finally the forward end face 32 of the clamping sleeve 2 also places itself upon the workpiece, and from now onwards, if the screw is not yet completely screwed into the workpiece, both the bearing sleeve 1 and the clamping sleeve 2 are pressed back in relation to the screw driving shaft 20. The springs 4 and 5 are here correspondingly compressed, but the abutment tube 3 is driven by the screw driving shaft 20 since the spring 26, which is stronger than the springs 4 and 5, presses forward the perforated plate 25 and thus also the abutment tube 3 seated before the perforated plate 25. The spring 26 here bears against the shoulder 27 of the drive sleeve 22, which latter in turn is held axially in relation to the screw driving shaft 20/20' by the nut 23. In the operation as described thus the axial position of the abutment tube 3 and screw driving shaft 20 remains unchanged, which incidentally is valid for all working phases.

In FIG. 2 the operation of driving in the screw 13 is illustrated in its final phase. Here the head 14 lies against the workpiece 33. The bearing sleeve 1 and the clamping sleeve 2 are shifted back in relation to the screw driving shaft 20 and abutment tube 3. Now in this position the pushed back clamping sleeve has brought about an uncoupling, which is to be described below: The rear end face 34 of the clamping sleeve 2 presses through a clamp washer 35 upon the setting sleeve 36 with which the perforated plate 25 is lifted away from the coupling balls 29. This operation is to be explained in greater detail below with reference to FIGS. 3 and 4.

The setting sleeve 36 is shown in section in FIG. 3. It possesses the axial grooves 37 which, as shown by FIG. 3, are graduated at different lengths. The setting sleeve 36 is provided with three groups of grooves 37 graduated in this way, these three groups being mutually similar. Into the grooves 37 there extend three noses 38 of the perforated plate 25, the object being achieved by the association of the grooves 37 and noses 38 that the noses 38 in each case drop into grooves 37 of equal length. By rotation of the setting sleeve 36 in relation to the perforated plate 25 it is then possible to determine the respective depth of dropping of the noses 38 into the setting sleeve 36 according to choice. This signifies that according to the set depth of dropping of the noses 38 into the setting sleeve 36, the perforated plate 25 is lifted away, namely from the rear end face of the abutment tube 3, at different displacements of the bearing sleeve 1 and the clamping sleeve 2 in relation to the screw driving shaft 20. This lift-away operation thus takes place by reason of the running of the front end face 32 of the clamping sleeve 2 up against the workpiece 33, whereby the rear end face 34 of the clamping sleeve 2 displaces the setting sleeve 36 in relation to the abutment tube 3 as a result of pressure against the clamping washer 35 and the setting sleeve 36, the perforated plate 25 being entrained by means of the noses 38 of the perforated plate 25 and the ends of the grooves 37 set to them, the perforated plate 25 consequently lifting itself away from the rearward end face of the abutment tube 3 into the position as illustrated in FIG. 2.

Even at the beginning of this lift-off operation the apertures 28 of the perforated plate 25 come into the region to the coupling balls 29 where their surface extends more obliquely of the rear end face of the abutment tube 3, so that finally the perforated plate 25 can slide in ratchet manner over the coupling balls 29. The stress of the spring 26 is here exploited rendering it possible for the perforated plate 25 to yield to the rear against the shoulder 27. Thus now the previously existing force-engaging connection between perforated plate 25 and coupling balls 29 is eliminated, that is to say there is no longer a force-engaging connection between the drive sleeve 22 and the screw driving shaft 20, so that despite further rotation of the drive sleeve 22 the screw driving shaft 20 and thus the blade 21 remain stationary. The screw 13 is thus not driven further into the workpiece 33. In this case incidentally a ratchet noise occurs so that the attention of the operator is drawn to the fact that the screw-in operation is terminated. The chuck has here assumed the position as illustrated in FIG. 2, in which it can readily be withdrawn from the screw 13. The springs 4 and 5 then press the bearing sleeve 1 and the clamping sleeve 2 forward again, and the perforated plate 25 can also place itself again against the rear end face of the abutment tube 3. Finally then the chuck resumes the position as illustrated in FIG. 1 (without there being a screw in place).

Since the setting sleeve 36 is arranged axially displaceably and rotatably in relation to the abutment tube 3, but on the other hand it is also to be ensured that the setting sleeve 36 does not rotate in an undesired manner due to jolting or otherwise, the already above-mentioned clamping washer 35 is provided which is seated with a light stress on the abutment tube 3 and therefore cannot shift of its own accord in relation to the abutment tube 3. For the desired adjustment of the setting sleeve 36 it is firstly pushed against the end face 34 of the clamping sleeve 2 and then rotated so that the noses 38 stand before the desired grooves 37. Thereupon the setting sleeve 36 together with the clamping washer 35 is brought into the position as illustrated in FIG. 1 merely by axial displacement (that is without rotation), in which position the clamp washer 35 holds the setting sleeve 36 fast. In place of the clamp washer 35 a helical spring can also be used.

In the example of embodiment as illustrated in FIG. 5 another form of the coupling is provided. As regards the function of bearing sleeve 1, clamping sleeve 2 and clamping balls 12 and of the associated other parts, reference can be made to the above description since the same functions are present in this respect.

In the form of embodiment according to FIG. 5 the force-engaging connection between drive sleeve 22 and screw driving shaft 20 is constituted as follows: The drive sleeve 22 extends in a manner similar to that of the example of embodiment according to FIG. 1, with a square neck into a correspondingly square aperture of the abutment tube 39, which thus is constantly entrained by the drive sleeve 22. In this case the abutment tube 39 is axially displaceably mounted on the square neck 24. By means of the spring 26, which bears opposite to the shoulder 27 on the drive sleeve 22, the abutment tube 39 is pressed forwards. Radially inwardly protruding coupling pins 40 are let in one plane into the abutment tube 39 and form a rigid connection with the abutment tube 39. The coupling pins 40 extend inwards into a turned recess of the abutment tube 39 into which the screw driving shaft 20 extends with its annular shoulder 41. As may be seen clearly especially from FIGS. 7 and 8, the annular shoulder 41 possesses adapted grooves 42 opposite to the coupling pins 40, into each of which a coupling pin 40 drops. The coupling pins 40 are here received by the grooves 42 to such extent that the coupling pins 40 act in relation to the grooves 42 practically like engaging members. At their sides the grooves 42 merge into bevels 43, by which the object is achieved that on lifting of the coupling pins 40 out of the grooves 42 the coupling pins 40 can rotate further in relation to the annular shoulder 41, which corresponds to the position in the uncoupled condition. The coupling pins 40 here slide over the edges 44 lying between the grooves 42, which edges ensure that the tendency is always imparted to the coupling pins 40 to slide over the bevels 43 into the grooves 42. In this way the possibility of the coupling pins 40 remaining stationary in a central position between the grooves 42 is prevented.

If thus the coupling pins 40 lie in the grooves 42, there is a force-engaging connection from the drive sleeve 22 through the abutment tube 39, the coupling pins 40 to the screw driving shaft 20, so that on driving of the drive sleeve 22 the blade 21 of the screw driving shaft 20 is set in rotation.

Now the clamping of a screw 13 and its screwing into a workpiece take place in the same manner as described with reference to FIGS. 1 to 4. The application of the front ends 31 and 32 of the bearing sleeve 1 and of the clamping sleeve 2 to the workpiece 33 here also takes place, the bearing sleeve 1 and clamping sleeve 2 moving back in relation to the abutment tube 39. Here the bearing sleeve 1 finally reaches the position as illustrated in FIG. 6 in which the rear end face 45 of the bearing sleeve 1 strikes against the set screw 46. The set screw 46 is screwed into the abutment tube 39 so that as the screwing-in operation progresses, in which the screw driving shaft 20/20' advances in relation to the bearing sleeve 1, a corresponding displacement of the screw driving shaft 20 in relation to the bearing sleeve 39 also takes place, since the latter is now halted by the bearing sleeve 1 striking against the workpiece 33. The consequence of this is a lifting of the annular shoulder 41 of the screw driving shaft 20 away from the coupling pins 40 seated fast in the abutment tube 39. The coupling pins 40 here slide out of the grooves 42, whereby the force-engaging connection of drive sleeve 22 with screw driving shaft 20 is interrupted. The coupling pins 40 can now slide up over the bevels 43 and are thereafter repeatedly guided over the edges 44, and in each case the position of coupling pins 40 and screw driving shaft 20 as illustrated in FIG. 9 results, in which the screw 13 is also fully screwed into the workpiece 33. The screw driving shaft 20 halts, the operator knows from the ratchet noise of the coupling pins 40 sliding over the edges 44 that the screw driving operation is terminated.

In this uncoupling operation it is also essential that the abutment tube 39 is shifted to the rear in relation to the drive sleeve 22 so that then the screw driving shaft 20/20' cannot likewise yield to the rear, since in fact then the coupling pins 40 would not be lifted out of the grooves 42. The advance position of the screw driving shaft 20/20' in each case is retained due to the fact that the thinner part 20' of the screw driving shaft 20 bears with the shoulder 47 against the inner shoulder 48 of the drive sleeve 22. If thus by reason of the advance of the drive sleeve 22 together with the screw driving shaft 20/20' the abutment tube 39 is finally shifted to the rear in relation to the screw driving shaft 20/20' over the set screw 46, then this shifting operation, in which the coupling pins 40 are lifted out of the grooves 42, cannot also shift the screw driving shaft 20/20' back, so that thus the desired disengagement of the coupling pins 40 from the grooves 42 is also achieved.

The stepless adjustability of the set screw 46 renders it possible to achieve a correspondingly stepless adjustment of the blade 21, in which the uncoupling operation is initiated.

It should also be pointed out that in the form of embodiment as represented in FIG. 1 it is also possible to avoid inward dropping out of the clamping balls 12 due to the fact that a correspondingly large diameter is imparted to the clamping balls 12. In the case of such larger clamping balls 12 they strike with their mutually inwardly facing surfaces against one another if no screw 16 is situated in the chuck. If then the minimum diameter of the clamping taper 18 of the clamping sleeve 2 is smaller than the external diameter of the ball ring consisting of the clamping balls 12 (for example four clamping balls) thus abutting on one another, the bearing sleeve 1 cannot fall out of the clamping sleeve 2, so that in this case it is possible to dispense with the collar 7.

The chuck as described can be used in combination with appropriate drive machines, for example percussive drills, likewise for driving in nails. In this case the coupling containing the coupling balls 29 and the perforated plate 25 is omitted and the screw driving shaft 20 is clamped directly into the chuck of the drive machine. A connection between screw driving shaft 20 and abutment tube 3 can be constituted for example by radially arranged pins or screws. In FIG. 10 for this purpose the pin 49 is illustrated. So that the heads of the nails are introduced centrally into the chuck, even if they are smaller in diameter than the internal diameter of the bearing bush 1, a guide sleeve 52 is axially displaceably fitted on to the screw driving shaft 20 and is subject to the pressure of the spring 51. This spring 51 permits the guide sleeve 52 to yield back in relation to the screw driving shaft 20 when the nail head approaches or penetrates into the workpiece. The spring 51 is arranged on the screw driving shaft 20 so that it prevents the guide sleeve 52 from falling out of the bearing bush 1. This is achieved due to the fact that the spring 51 is set with a few of its turns in a corresponding threading 53 on the screw driving shaft 20 and/or threading 54 in the guide sleeve 52. The screw driving shaft 20 has a blunt end face 55 for nailing.

The chuck according to the invention can also be used in combination with screw drivers with adjustable torque clutch. In this case the above-mentioned coupling is likewise omitted. The screw driving shaft 20 is then formed at its rear end so that it snaps into the socket of the screw driver, that is ordinarily with hexagon as drive member and annular grooves as retainers. The connection between abutment tube 3 and screw driving shaft 20 takes place as in the embodiment as illustrated in FIG. 10 for nailing with transverse pins or screws 49. Since in this case the screw driving shaft 20 is provided with a blade (21 in FIG. 1) at its forward end, no guide sleeve 52 is required as in nailing.

I claim:

1. A chuck for holding and driving fasteners comprising a bearing sleeve (1) having a forward end portion (31), a plurality of apertures (11) in said bearing sleeve (1) adjacent said forward end portion (31), a plurality of clamping balls (12), one for each of said apertures (11), a clamping sleeve (2) having a front end (32) and a rear end (34), said clamping sleeve (2) surrounding said bearing sleeve (1) and being longitudinally displaceable with respect thereto, abutting means (10) on said clamping sleeve (2) adjacent said rear end (34), an abutment sleeve (3) slidably disposed within said clamping sleeve (2) and having a collar end (8) adapted to engage said abutting means (10) to limit forward movement of said clamping sleeve (2), a first compression spring (5) mounted in compression between said abutment sleeve (3) and said clamping sleeve (2) for normally biasing said clamping sleeve (2) forward with respect to said abutment sleeve (3), a second compression spring (4) mounted inside said first compression spring (5) in compression between said bearing sleeve (1) and said abutment sleeve (3) for normally biasing said bearing sleeve (1) forward with respect to said abutment sleeve (3), a clamping taper (18) in said clamping sleeve (2) adjacent said front end (32) adapted to force the clamping balls (12) inwardly toward each other into a clamping position to clamp a shank (16) of a fastener (13) therebetween as said bearing sleeve (1) is urged forward by said second spring (4) while said clamping sleeve (2) is prevented from moving forward by said abutting means (10), a free space (15) in said clamping sleeve (2) adjacent said clamping taper (18) adapted to allow said balls (12) to move outwardly away from each other into a non-clamping position, thereby releasing the shank (16) of the fastener (13), when said bearing sleeve (1) is moved rearwardly against the bias of said second spring (4) into alignment against a workpiece with said bearing sleeve (1), a screw driving shaft (20) having a blade end (21) slidably and rotatably disposed in said bearing sleeve (1) and a driven end (50) affixed to said abutment sleeve (3) for unitary rotation therewith, a drive sleeve (22) for rotating said screw driving shaft (20), and a force-engaging connection between said drive sleeve (22) and said screw driving shaft (20), said force-engaging connection including uncoupling means adapted to terminate automatically rotation of said screw driving shaft (20) when said forward end (32) of said clamping sleeve (2) abuts against a workpiece and said rear end (34) of said clamping sleeve (2) abuts against said force-engaging connection in an uncoupling position to prevent further driving of the fastener (13).

2. A chuck as recited in claim 1 wherein said force-engaging connection includes a plurality of coupling balls (29) partially embedded in a rear face of said abutment sleeve (3), a perforated plate (25) having a plurality of holes (28) therein adapted to engage said coupling balls (29) operatively to connect said perforated plate (25) with said abutment sleeve (3), a square neck (24) on said drive sleeve (22), said perforated plate (25) being mounted on said square neck (24) so as to slide thereupon and to be driven thereby, a third spring (26) mounted in compression between said drive element (22) and said perforated plate (25) normally biasing said perforated plate (25) into engagement with said balls (29), said perforated plate (25) having a plurality of radially extending noses (38), and a setting sleeve (36) adapted to bear rearwardly against said noses (38) when said clamping sleeve (2) is moved rearward by a workpiece a preset distance into abutting relationship with said setting sleeve (36), overcoming the bias of said third spring (26) and moving said perforated plate (25) rearward out of engagement with said coupling balls (29), thereby automatically disengaging said force-engaging connection to prevent further driving of the fastener.

* * * * *